US007404301B2

(12) United States Patent
Huang et al.

(10) Patent No.: US 7,404,301 B2
(45) Date of Patent: Jul. 29, 2008

(54) LNG FACILITY PROVIDING ENHANCED LIQUID RECOVERY AND PRODUCT FLEXIBILITY

(76) Inventors: Shawn S. Huang, 1110 Chelshurst Way, Spring, TX (US) 77379; Harry J. Crofton, 3733 Drummond, Houston, TX (US) 77025; Jame Yao, 1151 Gloria Ct., Sugar Land, TX (US) 77478; Thomas M. Jones, 2426 Oyster Loop Dr., Sugar Land, TX (US) 77478; Weldon Ransbarger, 5510 Charlestown Colony, Houston, TX (US) 77084; Philip C. Goundry, 3219 Trotwood, Katy, TX (US) 77494

( * ) Notice: Subject to any disclaimer, the term of this patent is extended or adjusted under 35 U.S.C. 154(b) by 349 days.

(21) Appl. No.: 11/212,798

(22) Filed: Aug. 26, 2005

(65) Prior Publication Data

US 2007/0012071 A1 Jan. 18, 2007

Related U.S. Application Data

(60) Provisional application No. 60/698,402, filed on Jul. 12, 2005.

(51) Int. Cl.

| | |
|---|---|
| ***C10L 1/04*** | (2006.01) |
| ***F25J 1/00*** | (2006.01) |
| ***F25J 3/00*** | (2006.01) |

(52) U.S. Cl. ..... 62/613; 62/620; 62/628; 585/1; 585/302

(58) Field of Classification Search ..... 62/613, 62/620, 630, 628, 611; 585/1, 302
See application file for complete search history.

(56) References Cited

U.S. PATENT DOCUMENTS

| | | | | |
|---|---|---|---|---|
| 2,688,534 | A * | 9/1954 | Howard | 48/190 |
| 3,057,706 | A * | 10/1962 | Marshall et al. | 48/127.1 |
| 3,429,805 | A * | 2/1969 | Karbosky | 208/354 |
| 3,456,032 | A * | 7/1969 | Ludwig | 585/650 |
| 3,527,585 | A | 9/1970 | Ungerleider | |
| 3,548,024 | A * | 12/1970 | Ludwig | 585/654 |
| 4,111,637 | A * | 9/1978 | Hillman, II | 431/12 |
| 4,277,254 | A * | 7/1981 | Hanson | 48/189.1 |
| 4,435,198 | A * | 3/1984 | Gray | 62/622 |
| 6,125,653 | A * | 10/2000 | Shu et al. | 62/622 |
| 2003/0226373 | A1 | 12/2003 | Prible et al. | |
| 2004/0079107 | A1 | 4/2004 | Wilkinson et al. | |
| 2005/0204625 | A1 * | 9/2005 | Briscoe et al. | 48/127.3 |

FOREIGN PATENT DOCUMENTS

| | | |
|---|---|---|
| JP | 62-072999 | 3/1987 |
| JP | 2001208297 A * | 8/2001 |

OTHER PUBLICATIONS

Bob Dimitroff, Address at the FERC Conference in Washington, D.C. (Feb. 18, 2004), Panel 1 Technical Perspectives on Gas Interchangeability and Quality "Gas Quality & Interchangeability 101".

* cited by examiner

*Primary Examiner*—William C Doerrler
(74) *Attorney, Agent, or Firm*—ConocoPhillips Company

(57) ABSTRACT

A single LNG facility, and operating method therefor, capable of efficiently producing LNG products that meet the varying specifications of different LNG markets.

29 Claims, 3 Drawing Sheets

LNG FACILITY PROVIDING ENHANCED LIQUID RECOVERY AND PRODUCT FLEXIBILITY

RELATED APPLICATIONS

This application claims the priority benefit under 35 U.S. C. Section 119(e) of U.S. Provisional Patent Application Ser. No. 60/698,402, filed Jul. 12, 2005, the entire disclosure of which is incorporated herein by reference.

BACKGROUND OF THE INVENTION

1. Field of the Invention

This invention relates to a method and apparatus for liquefying natural gas. In another aspect, the invention concerns an improved liquefied natural gas (LNG) facility capable of efficiently supplying LNG products meeting significantly different product specifications.

2. Description of the Prior Art

The cryogenic liquefaction of natural gas is routinely practiced as a means of converting natural gas into a more convenient form for transportation and storage. Such liquefaction reduces the volume of the natural gas by about 600-fold and results in a product which can be stored and transported at near atmospheric pressure.

Natural gas is frequently transported by pipeline from the supply source to a distant market. It is desirable to operate the pipeline under a substantially constant and high load factor but often the deliverability or capacity of the pipeline will exceed demand while at other times the demand may exceed the deliverability of the pipeline. In order to shave off the peaks where demand exceeds supply or the valleys when supply exceeds demand, it is desirable to store the excess gas in such a manner that it can be delivered when demand exceeds supply. Such practice allows future demand peaks to be met with material from storage. One practical means for doing this is to convert the gas to a liquefied state for storage and to then vaporize the liquid as demand requires.

The liquefaction of natural gas is of even greater importance when transporting gas from a supply source which is separated by great distances from the candidate market and a pipeline either is not available or is impractical. This is particularly true where transport must be made by ocean-going vessels. Ship transportation in the gaseous state is generally not practical because appreciable pressurization is required to significantly reduce the specific volume of the gas. Such pressurization requires the use of more expensive storage containers.

In order to store and transport natural gas in the liquid state, the natural gas is preferably cooled to −240° F. to −260° F. where the liquefied natural gas (LNG) possesses a near-atmospheric vapor pressure. Numerous systems exist in the prior art for the liquefaction of natural gas in which the gas is liquefied by sequentially passing the gas at an elevated pressure through a plurality of cooling stages whereupon the gas is cooled to successively lower temperatures until the liquefaction temperature is reached. Cooling is generally accomplished by indirect heat exchange with one or more refrigerants such as propane, propylene, ethane, ethylene, methane, nitrogen, carbon dioxide, or combinations of the preceding refrigerants (e.g., mixed refrigerant systems). A liquefaction methodology which is particularly applicable to the current invention employs an open methane cycle for the final refrigeration cycle wherein a pressurized LNG-bearing stream is flashed and the flash vapors (i.e., the flash gas stream(s)) are subsequently employed as cooling agents, recompressed, cooled, combined with the processed natural gas feed stream and liquefied thereby producing the pressurized LNG-bearing stream.

In the past, LNG facilities have been designed and operated to provide LNG to a single market in a specific region of the world. As global demand for LNG increases, it would be advantageous for a single LNG facility to be able to supply LNG to multiple markets in different regions of the world. However, natural gas specifications vary greatly throughout the world. Typically, these natural gas specifications include criteria such as heating value, Wobbe index, methane content, ethane content, $C_{3+}$ content, and inerts content.

Existing LNG facilities are optimized to produce LNG meeting a certain set of specifications for a single market. Thus, changing the operating parameters of an LNG facility in an effort to make LNG that would meet the non-design specifications of a different market creates significant operating inefficiencies in the facility. These operating inefficiencies associated with producing LNG for non-design specifications generally makes it economically unfeasible to serve more than one market with a single LNG facility.

OBJECTS AND SUMMARY OF THE INVENTION

It is, therefore, an object of the present invention to provide a single LNG facility capable of efficiently producing LNG that can meet significantly different specifications of two or more markets.

A further object of the invention is to provide a method of operating the LNG facility for producing multi-specification LNG.

It should be understood that the above-listed objects are only exemplary, and not all the objects listed above need be accomplished by the invention described and claimed herein.

Accordingly, one aspect of the present invention concerns a method of supplying LNG of varying high heating value (HHV) via a single LNG facility. The method includes the following steps: (a) using the LNG facility to produce initial LNG having an HHV less than about 1,150 BTU/SCF; (b) cooling a spiking fluid having an HHV greater than about 1,500 BTU/SCF to a temperature less than about −100° C., wherein at least a portion of the cooling is provided by the LNG facility; and (c) combining at least a portion of the initial LNG and at least a portion of the cooled spiking fluid to thereby provide spiked LNG having a higher HHV than the initial LNG.

Another aspect of the present invention concerns a method including the following steps: (a) removing an initial LNG stream having a higher heating value (HHV) less than 1,150 BTU/SCF from a first LNG tank; (b) combining a spiking fluid having an HHV greater than 1,500 BTU/SCF with the removed initial LNG stream to thereby form a spiked LNG stream; and (c) introducing at least a portion of the spiked LNG stream into a second LNG tank.

A further aspect of the present invention concerns a facility for producing LNG from natural gas. The facility includes the following components: (a) a first refrigeration cycle employing a first refrigerant to cool the natural gas via indirect heat exchange; (b) a first distillation column for receiving at least a portion of the natural gas cooled by the first refrigeration cycle and separating the cooled natural gas into a first relatively more volatile fraction and a first relatively less volatile fraction; (c) a second refrigeration cycle employing a second refrigerant to further cool at least a portion of the first relatively more volatile fraction to thereby produce initial LNG; (d) a first tank for receiving and storing at least a portion of the initial LNG; (e) a second tank for receiving and storing a spiking fluid formed at least partly from the first relatively less volatile fraction; and (f) a mixing chamber fluidly coupled to and disposed outside of the first and second tanks, wherein the mixing chamber permits mixing of fluids from the first and second tanks.

BRIEF DESCRIPTION OF THE DRAWING FIGURES

DETAILED DESCRIPTION OF THE PREFERRED EMBODIMENT

Figure 1:
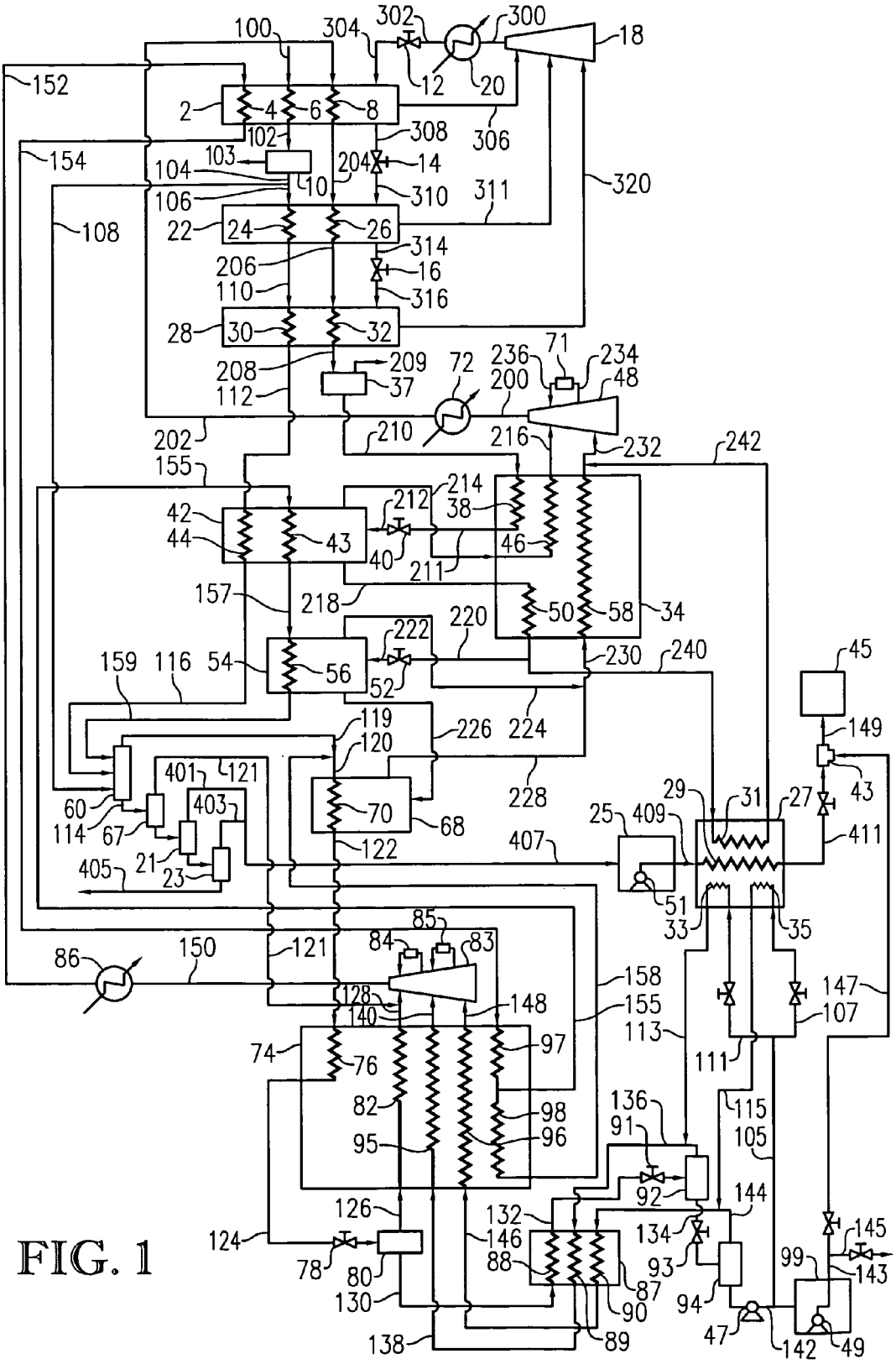
FIG. 1 is a simplified flow diagram of a cascaded refrigeration process for producing LNG to meet various specifications of different markets, particularly illustrating a system that stores a high-BTU spiking fluid at relative low temperature and then cools the spiking fluid to near-LNG temperature as it is combined with LNG.

Although the present invention is described herein primarily with reference to a cascade refrigeration process, it should be understood that, in light of the present disclosure, the invention could readily be adapted for use in other refrigeration processes (e.g., a mixed refrigerant process). A cascaded refrigeration process uses one or more refrigerants to transfer heat energy from a natural gas stream to the refrigerants, and ultimately transferring the heat energy to the environment. In essence, the overall refrigeration system functions as a heat pump by removing heat energy from the natural gas stream as the stream is progressively cooled to lower and lower temperatures. The design of a cascaded refrigeration process involves a balancing of thermodynamic efficiencies and capital costs. In heat transfer processes, thermodynamic irreversibilities are reduced as the temperature gradients between heating and cooling fluids become smaller, but obtaining such small temperature gradients generally requires significant increases in the amount of heat transfer area, major modifications to various process equipment, and the proper selection of flow rates through such equipment so as to ensure that both flow rates and outlet temperatures are compatible with the required heating/cooling duty.

As used herein, the term "open-cycle cascaded refrigeration process" refers to a cascaded refrigeration process comprising at least one closed refrigeration cycle and one open refrigeration cycle where the boiling point of the refrigerant employed in the open cycle is less than the boiling point of the refrigerant employed in the closed cycle and a portion of the cooling duty to condense the compressed open-cycle refrigerant is provided by one or more of the closed cycles. In one embodiment of the present invention, a predominately methane stream is employed as the refrigerant in the open cycle. This predominantly methane stream is preferably derived from the processed natural gas feed stream and can include compressed open methane cycle gas streams. As used herein, the terms "predominantly", "primarily", "principally", and "in major portion", when used to describe the presence of a particular component of a fluid stream, shall mean that the fluid stream is comprised of at least 50 mole percent of the stated component. For example, a "predominantly" methane stream, a "primarily" methane stream, a stream "principally" comprised of methane, or a stream comprised "in major portion" of methane each denote a stream comprised of at least 50 mole percent methane.

One of the most efficient and effective means of liquefying natural gas is via an optimized cascade-type operation in combination with expansion-type cooling. Such a liquefaction process involves the cascade-type cooling of a natural gas stream at an elevated pressure, (e.g., about 650 psia) by sequentially cooling the gas stream via passage through a multistage propane refrigeration cycle, a multistage ethane or ethylene refrigeration cycle, and an open-end methane refrigeration cycle which utilizes a portion of the feed gas as a source of methane and which includes therein a multistage expansion cycle to further cool the same and reduce the pressure to near-atmospheric pressure. In the sequence of cooling cycles, the refrigerant having the highest boiling point is utilized first followed by a refrigerant having an intermediate boiling point and finally by a refrigerant having the lowest boiling point. As used herein, the terms "upstream" and "downstream" shall be used to describe the relative positions of various components of a liquified natural gas (LNG) facility along the main flow path of natural gas through the facility.

Various pretreatment steps can be provided to remove certain undesirable components, such as acid gases, mercaptans, mercury, and moisture from the natural gas feed stream delivered to the LNG facility. The composition of this gas stream may vary significantly. As used herein, a natural gas stream is any stream principally comprised of methane which originates in major portion from a natural gas feed stream, such feed stream for example containing at least 85 mole percent methane, with the balance being ethane, higher hydrocarbons, nitrogen, carbon dioxide, and a minor amount of other contaminants such as mercury, hydrogen sulfide, and mercaptan. The pretreatment steps may be separate steps located either upstream of the cooling cycles or located downstream of one of the early stages of cooling in the initial cycle. The following is a non-inclusive listing of some of the available means which are readily known to one skilled in the art. Acid gases and to a lesser extent mercaptans are routinely removed via a chemical reaction process employing an aqueous amine-bearing solution. This treatment step is generally performed upstream of the cooling stages in the initial cycle. A major portion of the water is routinely removed as a liquid via two-phase gas-liquid separation following gas compression and cooling upstream of the initial cooling cycle and also downstream of the first cooling stage in the initial cooling cycle. Mercury is routinely removed via mercury sorbent beds. Residual amounts of water and acid gases are routinely removed via the use of properly selected sorbent beds such as regenerable molecular sieves.

The pretreated natural gas feed stream is generally delivered to the liquefaction process at an elevated pressure or is compressed to an elevated pressure generally greater than 500 psia, preferably about 500 psia to about 3000 psia, still more preferably about 500 psia to about 1000 psia, still yet more preferably about 600 psia to about 800 psia. The feed stream temperature is typically near ambient to slightly above ambient. A representative temperature range being 60° F. to 150° F. (10-65° C.).

As previously noted, the natural gas feed stream is cooled in a plurality of multistage refrigeration cycles (preferably three) by indirect heat exchange with a plurality of different refrigerants (preferably three). The overall cooling efficiency for a given cycle improves as the number of stages increases but this increase in efficiency is accompanied by corresponding increases in net capital cost and process complexity. The feed gas is preferably passed through an effective number of refrigeration stages, nominally two, preferably two to four, and more preferably three stages, in a first closed refrigeration cycle utilizing a relatively high boiling refrigerant. Such relatively high boiling point refrigerant is preferably comprised in major portion of propane, propylene, or mixtures thereof, more preferably the refrigerant comprises at least about 75 mole percent propane, even more preferably at least 90 mole percent propane, and most preferably the refrigerant consists essentially of propane. Thereafter, the processed feed gas flows through an effective number of stages, nominally two, preferably two to four, and more preferably two or three, in a second closed refrigeration cycle in heat exchange with a refrigerant having a lower boiling point. Such lower boiling point refrigerant is preferably comprised in major portion of ethane, ethylene, or mixtures thereof, more preferably the refrigerant comprises at least about 75 mole percent ethylene, even more preferably at least 90 mole percent ethylene, and most preferably the refrigerant consists essentially of ethylene. Each cooling stage comprises a separate cooling zone. As previously noted, the processed natural gas feed stream is preferably combined with one or more recycle streams (i.e., compressed open methane cycle gas streams) at various locations in the second cycle thereby producing a liquefaction stream. In the last stage of the second cooling cycle, the liquefaction stream is condensed (i.e., liquefied) in major portion, preferably in its entirety, thereby producing a pressurized LNG-bearing stream. Generally, the process pressure at this location is only slightly lower than the pressure of the pretreated feed gas to the first stage of the first cycle.

The pressurized LNG-bearing stream is then further cooled in a third refrigeration cycle referred to as the open methane cycle via contact in a main methane economizer (heat exchanger) with flash gases (i.e., flash gas streams) generated in this third cycle via sequential expansion of the pressurized LNG-bearing stream to near atmospheric pressure. The flash gases used as a refrigerant in the third refrigeration cycle are preferably comprised in major portion of methane, more preferably the flash gas refrigerant comprises at least 75 mole percent methane, still more preferably at least 90 mole percent methane, and most preferably the refrigerant consists essentially of methane. During expansion of the pressurized LNG-bearing stream to near atmospheric pressure, the pressurized LNG-bearing stream is cooled via at least one, preferably two to four, and more preferably three expansions where each expansion employs an expander as a pressure reduction means. Suitable expanders include, for example, either Joule-Thomson expansion valves or hydraulic expanders. The expansion is followed by a separation of the gas-liquid product with a separator. When a hydraulic expander is employed and properly operated, the greater efficiencies associated with the recovery of power, a greater reduction in stream temperature, and the production of less vapor during the flash expansion step will frequently more than off-set the higher capital and operating costs associated with the expander. In one embodiment, additional cooling of the pressurized LNG-bearing stream prior to flashing is made possible by first flashing a portion of this stream via one or more hydraulic expanders and then via indirect heat exchange means employing said flash gas stream to cool the remaining portion of the pressurized LNG-bearing stream prior to flashing. The warmed flash gas stream is then recycled via return to an appropriate location, based on temperature and pressure considerations, in the open methane cycle and will be recompressed.

Generally, the natural gas feed stream fed to the LNG facility will contain such quantities of $C_{2+}$ components so as to result in the formation of a $C_{2+}$ rich liquid in one or more of the cooling stages. This liquid is removed via gas-liquid separation means, preferably one or more conventional gas-liquid separators. Generally, the sequential cooling of the natural gas in each stage is controlled so as to remove as much of the $C_2$ and higher molecular weight hydrocarbons as possible from the gas to produce a gas stream predominating in methane and a liquid stream containing significant amounts of ethane and heavier components. An effective number of gas/liquid separation means are located at strategic locations downstream of the cooling zones for the removal of liquids streams rich in $C_{2+}$ components. The exact locations and number of gas/liquid separation means, preferably conventional gas/liquid separators, will be dependant on a number of operating parameters, such as the $C_{2+}$ composition of the natural gas feed stream, the desired BTU content of the LNG product, the value of the $C_{2+}$ components for other applications, and other factors routinely considered by those skilled in the art of LNG plant and gas plant operation. The $C_{2+}$ hydrocarbon stream or streams may be demethanized via a single stage flash or a fractionation column. In the latter case, the resulting methane-rich stream can be directly returned at pressure to the liquefaction process. In the former case, this methane-rich stream can be repressurized and recycle or can be used as fuel gas. The $C_{2+}$ hydrocarbon stream or streams or the demethanized $C_{2+}$ hydrocarbon stream may be used as fuel or may be further processed, such as by fractionation in one or more fractionation zones to produce individual streams rich in specific chemical constituents (e.g., $C_2$, $C_3$, $C_4$, and $C_{5+}$).

The liquefaction process described herein may use one of several types of cooling which include but are not limited to (a) indirect heat exchange, (b) vaporization, and (c) expansion or pressure reduction. Indirect heat exchange, as used herein, refers to a process wherein the refrigerant cools the substance to be cooled without actual physical contact between the refrigerating agent and the substance to be cooled. Specific examples of indirect heat exchange means include heat exchange undergone in a shell-and-tube heat exchanger, a core-in-kettle heat exchanger, and a brazed aluminum plate-fin heat exchanger. The physical state of the refrigerant and substance to be cooled can vary depending on the demands of the system and the type of heat exchanger chosen. Thus, a shell-and-tube heat exchanger will typically be utilized where the refrigerating agent is in a liquid state and the substance to be cooled is in a liquid or gaseous state or when one of the substances undergoes a phase change and process conditions do not favor the use of a core-in-kettle heat exchanger. As an example, aluminum and aluminum alloys are preferred materials of construction for the core but such materials may not be suitable for use at the designated process conditions. A plate-fin heat exchanger will typically be utilized where the refrigerant is in a gaseous state and the substance to be cooled is in a liquid or gaseous state. Finally, the core-in-kettle heat exchanger will typically be utilized where the substance to be cooled is liquid or gas and the refrigerant undergoes a phase change from a liquid state to a gaseous state during the heat exchange.

Vaporization cooling refers to the cooling of a substance by the evaporation or vaporization of a portion of the substance with the system maintained at a constant pressure. Thus, during the vaporization, the portion of the substance which evaporates absorbs heat from the portion of the substance which remains in a liquid state and hence, cools the liquid portion. Finally, expansion or pressure reduction cooling refers to cooling which occurs when the pressure of a gas, liquid or a two-phase system is decreased by passing through a pressure reduction means. In one embodiment, this expansion means is a Joule-Thomson expansion valve. In another embodiment, the expansion means is either a hydraulic or gas expander. Because expanders recover work energy from the expansion process, lower process stream temperatures are possible upon expansion.

Figure 2:
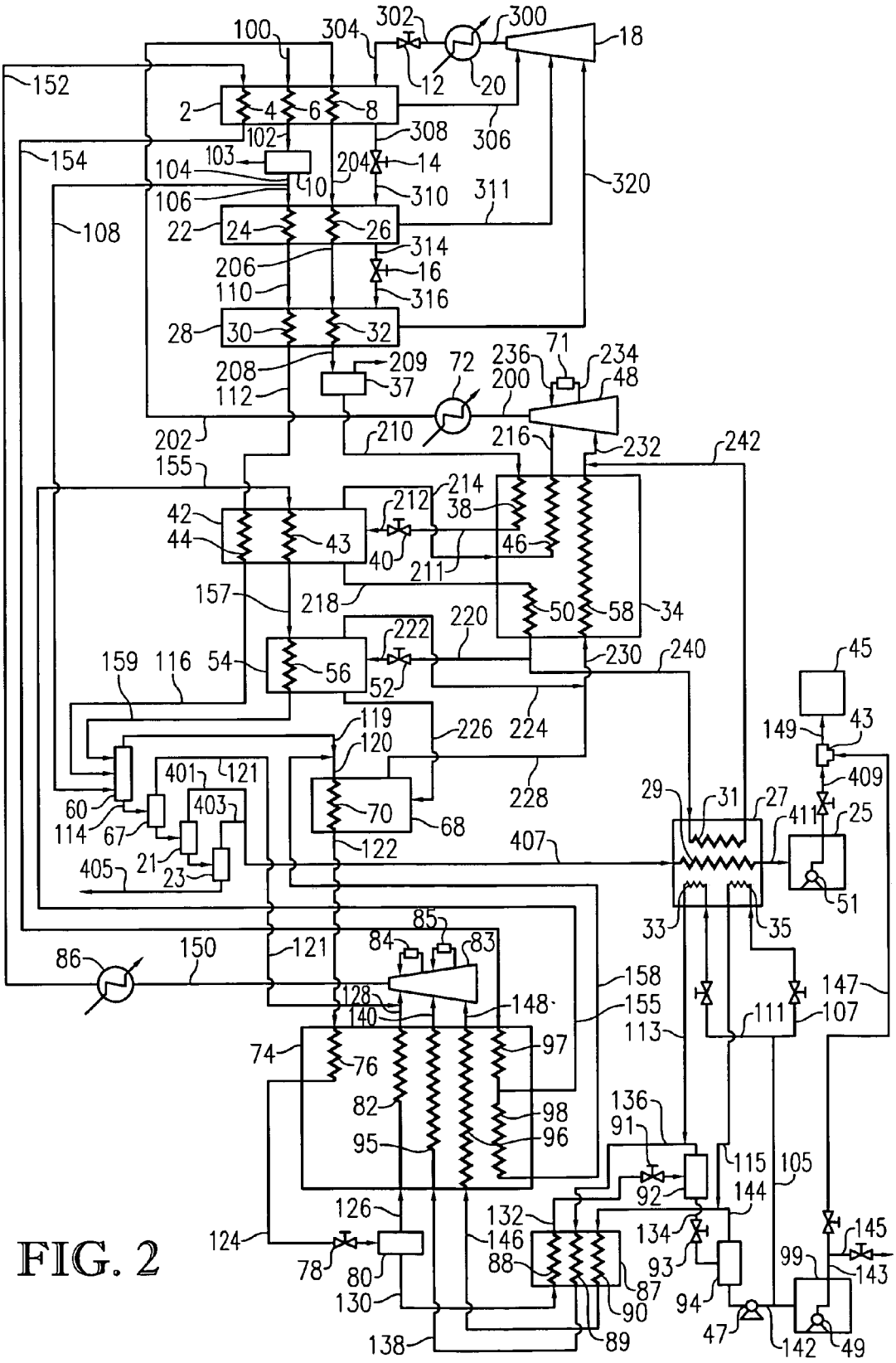
FIG. 2 is a simplified flow diagram of an alternative embodiment of a cascade refrigeration process for producing LNG to meet various specifications of different markets, particularly illustrating a system where the spiking fluid is cooled to near-LNG temperature prior to storing.
Figure 3:
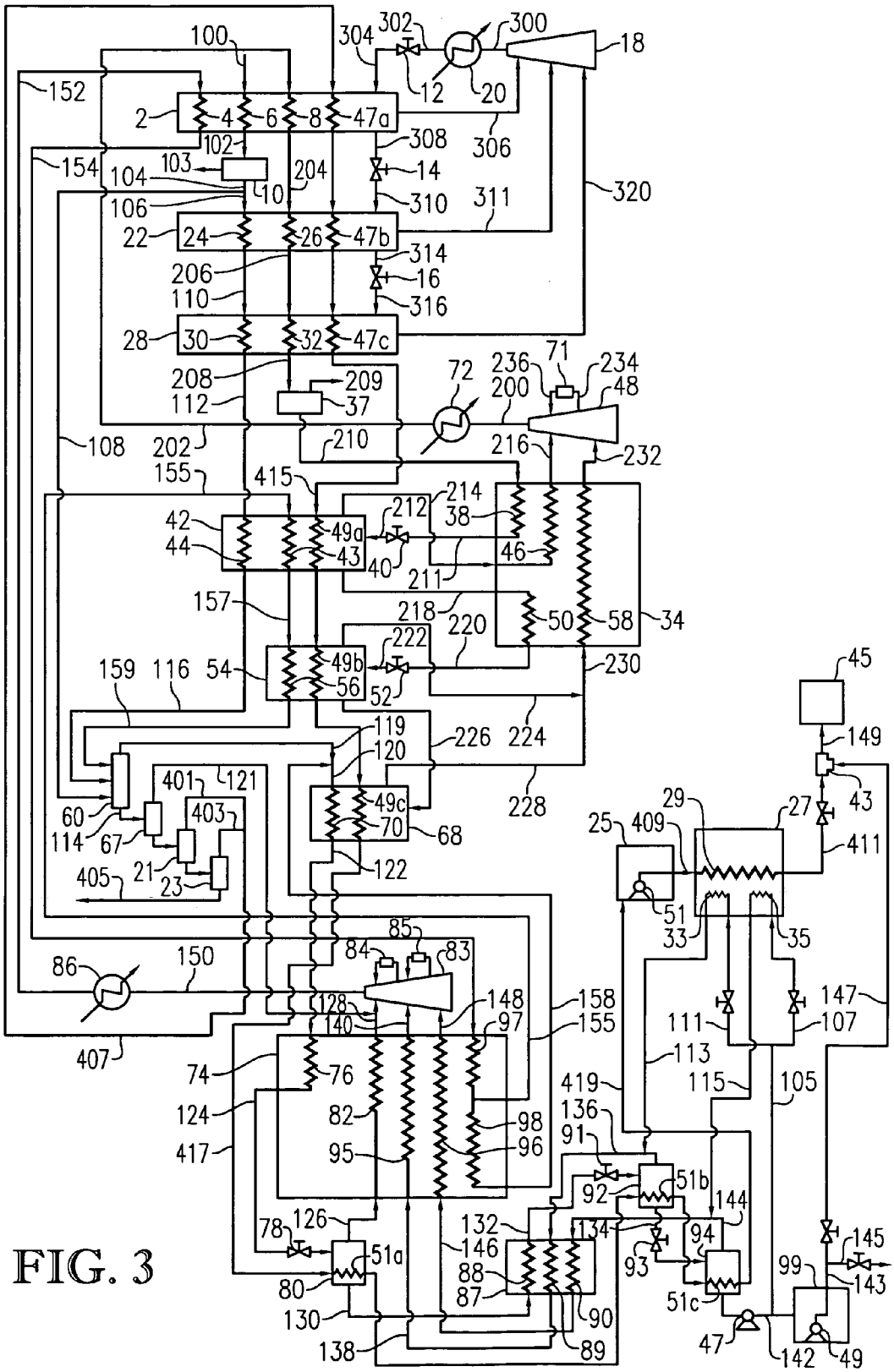
FIG. 3 is a simplified flow diagram of an alternative embodiment of a cascade refrigeration process for producing LNG to meet various market specifications, particularly illustrating a system where additional heat exchange passes are added to components of the main refrigeration cycles to provide cooling of the spiking fluid.

The flow schematics set forth in FIGS. 1-3 represent preferred embodiments of an inventive LNG facility capable of supplying LNG that meets two or more significantly different specifications. Those skilled in the art will recognize that FIGS. 1-3 are schematics only and, therefore, many items of equipment that would be needed in a commercial plant for successful operation have been omitted for the sake of clarity. Such items might include, for example, compressor controls, flow and level measurements and corresponding controllers, temperature and pressure controls, pumps, motors, filters, additional heat exchangers, and valves, etc. These items would be provided in accordance with standard engineering practice.

To facilitate an understanding of FIGS. 1-3, the following numbering nomenclature was employed. Items numbered 1 through 99 are process vessels and equipment which are associated with the liquefaction process. Items numbered 100 through 199 correspond to flow lines or conduits which contain predominantly methane streams. Items numbered 200 through 299 correspond to flow lines or conduits which contain predominantly ethylene streams. Items numbered 300 through 399 correspond to flow lines or conduits which contain predominantly propane streams. Items numbered 400 though 499 correspond to flow lines or conduits whose contents may vary significantly depending upon the mode of operation of the LNG facility.

Referring to FIG. 1, gaseous propane is compressed in a multistage (preferably three-stage) compressor 18 driven by a gas turbine driver (not illustrated). The three stages of compression preferably exist in a single unit although each stage of compression may be a separate unit and the units mechanically coupled to be driven by a single driver or combination of drivers. Upon compression, the compressed propane is passed through conduit 300 to a cooler 20 where it is cooled and liquefied. A representative pressure and temperature of the liquefied propane refrigerant prior to flashing is about 100° F. (38° C.) and about 190 psia. The stream from cooler 20 is passed through conduit 302 to a pressure reduction means, illustrated as expansion valve 12, wherein the pressure of the liquefied propane is reduced, thereby evaporating or flashing a portion thereof. The resulting two-phase product then flows through conduit 304 into a high-stage propane chiller 2 wherein gaseous methane refrigerant introduced via conduit 152, natural gas feed introduced via conduit 100, and gaseous ethylene refrigerant introduced via conduit 202 are respectively cooled via indirect heat exchange means 4, 6, and 8, thereby producing cooled gas streams respectively produced via conduits 154, 102, and 204.

The vaporized propane gas from chiller 2 is returned to the high-stage inlet port of compressor 18 through conduit 306. The remaining liquid propane is passed through conduit 308, the pressure further reduced by passage through a pressure reduction means, illustrated as expansion valve 14, whereupon an additional portion of the liquefied propane is flashed. The resulting two-phase stream is then fed to an intermediate-stage propane chiller 22 through conduit 310, thereby providing a coolant for chiller 22. The cooled feed gas stream from chiller 2 flows via conduit 102 to separation equipment 10 wherein gas and liquid phases are separated. The liquid phase, which can be rich in $C_{3+}$ components, is removed via conduit 103. The gaseous phase is removed via conduit 104 and then split into two separate streams which are conveyed via conduits 106 and 108. The stream in conduit 106 is fed to propane chiller 22. The stream in conduit 108 becomes the stripping gas to first distillation column 60, discussed in more detail below. Ethylene refrigerant from chiller 2 is introduced to chiller 22 via conduit 204. In chiller 22, the feed gas stream, also referred to herein as a methane-rich stream, and the ethylene refrigerant streams are respectively cooled via indirect heat transfer means 24 and 26, thereby producing cooled methane-rich and ethylene refrigerant streams via conduits 110 and 206. The vaporized portion of the propane refrigerant in chiller 22 is separated and passed through conduit 311 to the intermediate-stage inlet of compressor 18. Liquid propane refrigerant from chiller 22 is removed via conduit 314, flashed across a pressure reduction means, illustrated as expansion valve 16, and then fed to a low-stage propane chiller/condenser 28 via conduit 316.

As illustrated in FIG. 1, the methane-rich stream flows from intermediate-stage propane chiller 22 to the low-stage propane chiller 28 via conduit 110. In chiller 28, the methane-rich stream is cooled via indirect heat exchange means 30. In a like manner, the ethylene refrigerant stream flows from the intermediate-stage propane chiller 22 to low-stage propane chiller 28 via conduit 206. In the latter, the ethylene refrigerant is totally condensed or condensed in nearly its entirety via indirect heat exchange means 32. The vaporized propane is removed from low-stage propane chiller 28 and returned to the low-stage inlet of compressor 18 via conduit 320.

As illustrated in FIG. 1, the methane-rich stream exiting low-stage propane chiller 28 is introduced into high-stage ethylene chiller 42 via conduit 112. Ethylene refrigerant exits low-stage propane chiller 28 via conduit 208 and is preferably fed to a separation vessel 37 wherein light components are removed via conduit 209 and condensed ethylene is removed via conduit 210. The ethylene refrigerant at this location in the process is generally at a temperature of about −24° F. (−31° C.) and a pressure of about 285 psia. The ethylene refrigerant then flows to an ethylene economizer 34 wherein it is cooled via indirect heat exchange means 38, removed via conduit 211, and passed to a pressure reduction means, illustrated as an expansion valve 40, whereupon the refrigerant is flashed to a preselected temperature and pressure and fed to high-stage ethylene chiller 42 via conduit 212. Vaporized ethylene is removed from chiller 42 via conduit 214 and routed to ethylene economizer 34 wherein the vapor functions as a coolant via indirect heat exchange means 46. The ethylene vapor is then removed from ethylene economizer 34 via conduit 216 and fed to the high-stage inlet of ethylene compressor 48. The ethylene refrigerant which is not vaporized in high-stage ethylene chiller 42 is removed via conduit 218 and returned to ethylene economizer 34 for further cooling via indirect heat exchange means 50, removed from ethylene economizer via conduit 220, and flashed in a pressure reduction means, illustrated as expansion valve 52, whereupon the resulting two-phase product is introduced into a low-stage ethylene chiller 54 via conduit 222.

After cooling in indirect heat exchange means 44, the methane-rich stream is removed from high-stage ethylene chiller 42 via conduit 116. The stream in conduit 116 is then carried to a feed inlet of a first fractionation column 60. In column 60, the feed stream introduced is separated into a first relatively more volatile vapor stream exiting column 60 via conduit 119 and a first relatively less volatile liquid stream exiting column 60 via conduit 114. Typically, the overhead vapor stream in conduit 119 contains primarily methane (preferably >85 mole % methane), while the bottoms liquid stream in conduit 114 contains primarily $C_{2+}$ hydrocarbons. The separation/distillation in first fractionation column 60 is facilitated by the introduction of a stripping gas stream, via conduit 108, and a reflux stream, via conduit 159, into column 60.

Conduit 114 carries the bottoms liquid stream from first fractionation column 60 to a second fractionation column 67. In column 67, the stream introduced via conduit 114 is separated into a second relatively more volatile vapor stream exiting column 67 via conduit 121 and a second relatively less volatile liquid stream exiting the bottom of column 67. Typically, the overhead vapor stream in conduit 119 contains primarily methane and/or ethane, while the bottoms liquid stream contains primarily $C_{2+}$ or $C_{3+}$ hydrocarbons. In one embodiment of the present invention, the overhead vapor stream in conduit 121 is subsequently combined with a second stream in conduit 128, and the combined stream fed to the high-stage inlet port of the methane compressor 83.

The bottoms liquid stream from second fractionation column 67 is introduced into a third fractionation column 21. In column 21, this stream is separated into a third relatively more volatile vapor stream exiting column 21 via conduit 401 and a third relatively less volatile liquid stream exiting the bottom of column 21. Typically, the overhead vapor stream in conduit 401 contains primarily ethane and/or propane, while the bottoms liquid stream contains primarily $C_{3+}$ or $C_{4+}$ hydrocarbons.

The bottoms liquid stream from third fractionation column 21 is then introduced into a fourth fractionation column 23. In column 23, this stream is separated into a fourth relatively more volatile vapor stream exiting column 23 via conduit 403 and a fourth relatively less volatile liquid stream exiting the bottom of column 23 via conduit 405. Typically, the overhead vapor stream in conduit 403 contains primarily propane and/or butane, while the bottoms liquid stream contains primarily $C_{4+}$ or $C_{5+}$ hydrocarbons. In a preferred embodiment of the present invention, the overhead streams in conduits 401 and 403 are combined in conduit 407 to form a spiking fluid which can be stored in a spiking fluid storage tank 25.

It should be noted that while four fractionation columns 60,67,21,23 are illustrated in FIG. 1 and described above, various embodiments of the present invention may employ more fractionation columns or less fractionation columns. Further, the manner in which the fractionation columns 60,67,21,23 are operated may be varied to significantly alter the compositions of the streams exiting the columns. For example, the pressure and/or temperature of the streams flowing between fractionation columns 60,67,21,23 can be adjusted to facilitate the desired separation. In addition, it is possible for the spiking fluid stored in storage tank 25 to be formed from more or less than the two streams (401 and 403) illustrated in FIG. 1, so long as the spiking fluid has the properties/composition that will be described in detail below (See, Table 1).

The gas exiting high-stage propane chiller 2 via conduit 154 is fed to main methane economizer 74 wherein the stream is cooled via indirect heat exchange means 97. A first portion of the stream cooled in heat exchange mean 97 is removed from methane economizer 74 via conduit 155, introduced into high-stage ethylene chiller 44 for cooling via indirect heat exchange means 43, removed from chiller 44 via conduit 157, introduced into low-stage ethylene chiller 54 where it is condensed in indirect heat exchange means 56, and routed to first distillation column 60 via conduit 159 for use as a liquid reflux stream. A second portion of the cooled stream from heat exchange means 97 is then further cooled in indirect heat exchange means 98. The resulting further cooled stream is removed from methane economizer 74 via conduit 158 and is thereafter combined with the methane-rich overhead vapor stream exiting the top of first fractionation column 60 via conduit 119. The combined stream is fed to an ethylene condenser 68 via conduit 120. In ethylene condenser 68, this methane-rich stream is cooled and condensed via indirect heat exchange means 70 with the liquid effluent from low-stage ethylene chiller 54 which is routed to ethylene condenser 68 via conduit 226. The condensed methane-rich product from low-stage condenser 68 is produced via conduit 122. The vaporized ethylene from low-stage ethylene chiller 54, withdrawn via conduit 224, and ethylene condenser 68, withdrawn via conduit 228, are combined and routed, via conduit 230, to ethylene economizer 34 wherein the vapors function as a coolant via indirect heat exchange means 58. The stream is then routed via conduit 232 from ethylene economizer 34 to the low-stage inlet of ethylene compressor 48.

As illustrated in FIG. 1, the compressor effluent from vapor introduced via the low-stage side of ethylene compressor 48 is removed via conduit 234, cooled via inter-stage cooler 71, and returned to compressor 48 via conduit 236 for injection with the high-stage stream present in conduit 216. Preferably, the two-stages are a single module although they may each be a separate module and the modules mechanically coupled to a common driver. The compressed ethylene product from compressor 48 is routed to a downstream cooler 72 via conduit 200. The product from cooler 72 flows via conduit 202 and is introduced, as previously discussed, to high-stage propane chiller 2.

The pressurized LNG-bearing stream, preferably a liquid stream in its entirety, in conduit 122 is preferably at a temperature in the range of from about −200 to about −50° F. (−130° C. to −45° C.), more preferably in the range of from about −175 to about −100° F. (−115° C. to −73° C.), most preferably in the range of from −150 to −125° F. (−100° C. to −85° C.). The pressure of the stream in conduit 122 is preferably in the range of from about 500 to about 700 psia, most preferably in the range of from 550 to 725 psia. The stream in conduit 122 is directed to main methane economizer 74 wherein the stream is further cooled by indirect heat exchange means/heat exchanger pass 76 as hereinafter explained. It is preferred for main methane economizer 74 to include a plurality of heat exchanger passes which provide for the indirect exchange of heat between various predominantly methane streams in the economizer 74. Preferably, methane economizer 74 comprises one or more plate-fin heat exchangers. The cooled stream from heat exchanger pass 76 exits methane economizer 74 via conduit 124. The pressure of the stream in conduit 124 is then reduced by a pressure reduction means, illustrated as expansion valve 78, which evaporates or flashes a portion of the gas stream thereby generating a two-phase stream. The two-phase stream from expansion valve 78 is then passed to high-stage methane flash drum 80 where it is separated into a flash gas stream discharged through conduit 126 and a liquid phase stream (i.e., pressurized LNG-bearing stream) discharged through conduit 130. The flash gas stream is then transferred to main methane economizer 74 via conduit 126 wherein the stream functions as a coolant in heat exchanger pass 82. The predominantly methane stream is warmed in heat exchanger pass 82, at least in part, by indirect heat exchange with the predominantly methane stream in heat exchanger pass 76. The warmed stream exits heat exchanger pass 82 and methane economizer 74 via conduit 128.

The liquid-phase stream exiting high-stage flash drum 80 via conduit 130 is passed through a second methane economizer 87 wherein the liquid is further cooled by downstream flash vapors via indirect heat exchange means 88. The cooled liquid exits second methane economizer 87 via conduit 132 and is expanded or flashed via pressure reduction means, illustrated as expansion valve 91, to further reduce the pressure and, at the same time, vaporize a second portion thereof. This two-phase stream is then passed to an intermediate-stage methane flash drum 92 where the stream is separated into a gas phase passing through conduit 136 and a liquid phase passing through conduit 134. The gas phase flows through conduit 136 to second methane economizer 87 wherein the vapor cools the liquid introduced to economizer 87 via conduit 130 via indirect heat exchanger means 89. Conduit 138 serves as a flow conduit between indirect heat exchange means 89 in second methane economizer 87 and heat exchanger pass 95 in main methane economizer 74. The warmed vapor stream from heat exchanger pass 95 exits main methane economizer 74 via conduit 140 and is conducted to the intermediate-stage inlet of methane compressor 83.

The liquid phase exiting intermediate-stage flash drum 92 via conduit 134 is further reduced in pressure by passage through a pressure reduction means, illustrated as a expansion valve 93. Again, a third portion of the liquefied gas is evaporated or flashed. The two-phase stream from expansion valve 93 is passed to a final or low-stage flash drum 94. In flash drum 94, a vapor phase is separated and passed through conduit 144 to second methane economizer 87 wherein the vapor functions as a coolant via indirect heat exchange means 90, exits second methane economizer 87 via conduit 146, which is connected to the first methane economizer 74 wherein the vapor functions as a coolant via heat exchanger pass 96. The warmed vapor stream from heat exchanger pass 96 exits main methane economizer 74 via conduit 148 and is conducted to the low-stage inlet of compressor 83. The liquefied natural gas (LNG) product from low-stage flash drum 94, which is at approximately atmospheric pressure, is pumped via cryogenic pump 47 through conduit 142 to a first LNG storage tank 99.

As shown in FIG. 1, the high, intermediate, and low stages of compressor 83 are preferably combined as single unit. However, each stage may exist as a separate unit where the units are mechanically coupled together to be driven by a single driver. The compressed gas from the low-stage section passes through an inter-stage cooler 85 and is combined with the intermediate pressure gas in conduit 140 prior to the second-stage of compression. The compressed gas from the intermediate stage of compressor 83 is passed through an inter-stage cooler 84 and is combined with the high pressure gas provided via conduits 121 and 128 prior to the third-stage of compression. The compressed gas (i.e., compressed open methane cycle gas stream) is discharged from high stage methane compressor through conduit 150, is cooled in cooler 86, and is routed to the high pressure propane chiller 2 via conduit 152 as previously discussed. The stream is cooled in chiller 2 via indirect heat exchange means 4 and flows to main methane economizer 74 via conduit 154. The compressed open methane cycle gas stream from chiller 2 which enters the main methane economizer 74 undergoes cooling via flow through indirect heat exchange means 97. A first portion of the resulting cooled stream is withdrawn from methane economizer 74 via conduit 155, while a second portion of the cooled stream is further cooled in heat exchange means 98, as described above.

As discussed above, a spiking fluid can be generated by one or more fractionation columns (e.g., fractionation columns 60,67,21,23) of the LNG facility. This spiking fluid is preferably comprised of at least 50 mole percent $C_2$-$C_5$ hydrocarbons and has a higher heating value (HHV) of at least 1,500 BTU/SCF (British Thermal Units per Standard Cubic Foot). Table 1, below, provides preferred values for various properties and components of the initial spiking fluid that can be stored in storage tank 25 illustrated in FIG. 1.

TABLE 1

| Initial Spiking Fluid | | | |
|---|---|---|---|
| Property/Component | Preferred Value | More Preferred Value | Most Preferred Value |
| High Heating Value (BTU/SCF) | >1,500 | 1,750-8,000 | 2,000-5,000 |
| Methane ($C_1$) (mole %) | <50 | <25 | <10 |
| $C_2$-$C_5$ (mole %) | >50 | >80 | >95 |
| $C_2$-$C_4$ (mole %) | >50 | >75 | >90 |
| $C_2$-$C_3$ (mole %) | >50 | >70 | >85 |
| Temperature (° C.) | >−120 | −110 to 20 | −80 to −20 |
| Pressure (bar) | 0.5-5 | 0.9 to 1.5 | ~Atmospheric |

In accordance with one embodiment of the present invention at least a portion of the spiking fluid generated in the LNG facility is combined with at least a portion of the initial LNG generated in the facility to thereby form a spiked LNG having a significantly different composition and/or significantly different properties than the initial LNG in tank 99.

The initial LNG produced from the LNG facility preferably has a relatively low heating value so that subsequent combination with the spiking fluid provides spiked LNG having an increased heating value verses the initial LNG. Table 2, below, provides preferred values for various properties and components of the initial LNG that can be stored in LNG storage tank 99 illustrated in FIG. 1.

TABLE 2

| Initial LNG | | | |
|---|---|---|---|
| Property/Component | Preferred Value | More Preferred Value | Most Preferred Value |
| High Heating Valve (BTU/SCF) | <1,150 | 850-1,100 | 925-1,025 |
| Methane ($C_1$) (mole %) | >80 | 85-98 | 87.5-95 |
| Ethane ($C_2$) (mole %) | <10 | <8 | <6 |
| $C_{3+}$ (mole %) | <6 | <4 | <3 |
| Butane ($C_4$) (mole %) | <4 | <2 | <1 |
| Pentane ($C_5$) (mole %) | <2 | <1 | <0.5 |
| Inerts (mole %) | <8 | <6 | <4 |
| Temperature (° C.) | <−170 | −140 to −165 | −155 to −162 |
| Pressure (bar) | 0.5-5 | 0.9 to 1.5 | ~Atmospheric |

Referring to FIG. 1, the initial LNG in LNG storage tank 99 can be directly loaded onto a ocean-going vessel (not shown) via cryogenic pump 49, conduit 143, and conduit 145. Initial LNG from storage tank 99 can be transported on the ocean-going vessel to a distant market that has relatively low natural gas heating value specifications. Thus, when operated in a first mode, the LNG facility is capable of supplying LNG meeting relatively low heating value specifications.

If it is desired for the LNG facility to supply LNG to a market requiring a higher heating value product, the LNG facility can be operated in a second mode that includes pumping LNG from storage tank 99 through conduit 147 to a mixing chamber 43. In mixing chamber 43 the initial LNG is mixed with spiking fluid from tank 25 to produce spiked LNG that is then transported via conduit 149 to a spiked LNG tank 45. In one embodiment of the present invention, spiked LNG tank is a tank located on an ocean-going vessel. If spiked LNG tank 45 is a tank of an ocean-going vessel, then no additional land-based LNG storage tank is needed for the high heating value spiked LNG product. In another embodiment, spiked LNG tank 45 is a land-base storage tank. When spiked LNG tank is a land-based tank, both initial and spiked LNG can be stored on-site, and loaded onto one or more ocean-going vessels as required.

In order for the LNG facility depicted in FIG. 1 to make spiked LNG, the spiking fluid is pumped with pump 51 from spiking fluid storage tank 25 to spiking fluid heat exchanger 27 via conduit 409. Cooling of the spiking fluid is provided by indirect heat transfer between the spiking fluid in heat exchange means 29 and the refrigerant(s)/cooling agent(s) in heat exchange means 31, 33, and 35. In heat exchange means 29 of heat exchanger 27, the spiking fluid is preferably cooled by at least about 20° C., more preferably about 25 to about 200° C., and most preferably 50 to 100° C.

The refrigerant(s) used to cool the spiking fluid in heat exchanger 27 preferably originates from elsewhere in the LNG facility. More preferably the refrigerant(s) employed in heat exchanger 27 is formed primarily of propane, ethane, ethylene, and/or methane. Most preferably, the refrigerant employed in heat exchange means 31 is the predominately ethane and/or ethylene refrigerant of the LNG facility's ethylene refrigeration cycle. In one embodiment, a portion of the ethylene refrigerant in conduit 220 is split off, carried by conduit 240 to heat exchanger 27, passed through heat exchange means 31, and returned via conduit 242 to conduit 232 of the main ethylene refrigeration circuit. Most preferably, the refrigerants employed in heat exchange means 33 and 35 are predominately methane streams originating from the initial LNG produced by the LNG facility. In one embodiment, a portion of the initial LNG pumped through conduit 142 can be split off and carried through conduit 105. The LNG stream in conduit is split into two streams which are carried via conduits 107,111 to heat exchange means 35,33, respectively. The warmed streams from heat exchange means 33,35 are then transported via conduits 113,115 and combined with the flash gas streams in conduits 136,144, respectively.

The cooled spiking fluid exiting heat exchanger 27 via conduit 411 preferably has a temperature of less than about −100° C., more preferably less than about −125° C., and most preferably less than about −140° C. The cooled spiking fluid in conduit 411 and the initial LNG in conduit 147 are mixed/combined in mixing chamber 43. Mixing chamber 43 can take a variety of forms. It is preferred for mixing chamber to be located outside of tanks 25, 99, and 45. More preferably, mixing chamber 43 is simply defined by a conduit carrying the initial LNG from initial LNG tank 99 to spiked LNG tank 45, said conduit having an opening therein for introduction of the cooled spiking fluid. The ratio of the amount of spiking fluid to the amount of initial LNG combined in mixing chamber 43 can be adjusted to provide a spiked LNG product meeting higher heating value (HHV) specifications. Further, addition of the spiking fluid to the initial LNG can be carried out in an intermittent or pulsed manner, so long as the time-averaged ratio of initial LNG to spiking fluid provides the desired spiked LNG product. The term "time-averaged" is used herein to denote the amount of time required to substantially fill spiked LNG tank 45. Preferably, the time-averaged weight ratio of initial LNG to spiking fluid introduced into mixing chamber is in the range of from about 2:1 to about 100:1, more preferably in the range of from about 3:1 to about 75:1, and most preferably in the range of from 5:1 to 50:1. Preferably, the time-averaged HHV of the spiked LNG is at least about 2 percent greater than the HHV of the initial LNG, more preferably at least about 5 percent greater, and most preferably at least 8 percent greater. In addition, it is preferred for the time-averaged HHV of the spiked LNG to be at least about 10 BTU/SCF greater than the HHV of the initial LNG, more preferably in the range of from about 20 to about 400 BTU/SCF greater, and most preferably in the range of from 40 to 200 BTU/SCF greater.

FIG. 2 illustrates an alternative embodiment of the present invention. The embodiment illustrated in FIG. 2 is similar to the embodiment illustrated in FIG. 1; however, in the embodiment of FIG. 2, spiking fluid storage tank 25 is located downstream of spiking fluid heat exchanger 27 so that the spiking fluid is cooled prior to storage. The temperature of the cooled spiking fluid stored in storage tank 25 is preferably the same as the temperatures of the "cooled spiking fluid" described above with reference to FIG. 1. In the embodiment illustrated in FIG. 2, the cooled spiking fluid is stored in tank 25 at a temperature close to the temperature of the initial LNG in initial LNG tank 99. Preferably, the cooled spiking fluid in spiking fluid storage tank 25 has a temperature within about 50° C. of the temperature of the initial LNG in initial LNG storage tank 99, more preferably within about 25° C., and most preferably within 10° C. When it is desired to provide spiked LNG to spiked LNG tank 45, the spiking fluid pump 51 pumps the cooled spiking fluid to the mixing chamber 43 via conduit 409 and initial LNG pump 49 pumps the initial LNG to mixing chamber 43 via conduit 147. The spiked LNG then flows from mixing chamber 43 to spiked LNG tank 45 via conduit 149. As mentioned above, spiked LNG tank 45 can either be a permanent land-based storage tank or a storage tank located on an ocean-going vessel. Most preferably, spiked LNG tank 45 is located on an ocean-going vessel.

FIG. 3 illustrates an alternative embodiment of the present invention. The embodiment illustrated in FIG. 3 is similar to the embodiment illustrated in FIG. 2, in that the spiking fluid is cooled to near-LNG temperature prior to storage in spiking fluid storage tank 25. However, in the embodiment of FIG. 3, the manner in which the initial spiking fluid is cooled is significantly different than the manner shown in FIGS. 1 and 2. FIG. 3 illustrates an embodiment where cooling of the initial spiking fluid is carried out in additional cores added to existing vessels of the LNG facility. In particular, the initial spiking fluid in conduit 407 is cooled in additional heat exchange cores 47*a,b,c* located in propane chillers 2,22,28, respectively. After cooling via indirect heat exchange with the refrigerant in propane chillers 2,22,28, the partially-cooled spiking fluid in conduit 415 is cooled in additional heat exchange cores 49*a,b,c* located in ethylene chillers 42,54,68, respectively. After cooling via indirect heat exchange with the refrigerant in ethylene chillers 42,54,68, the further-cooled spiking fluid in conduit 417 is cooled in heat exchange cores 51*a,b,c* located in methane flash drums 80,92,94, respectively. The resulting cooled spiking fluid in conduit 419 preferably has the same temperature as the "cooled spiking fluid" described above with reference to FIGS. 1 and 2.

In the embodiment illustrated in FIG. 3, spiking fluid heat exchanger 27 is optional. If the temperature of the cooled spiking fluid stored in spiking fluid storage tank 25 is very close the temperature of the initial LNG in tank 99, then spiking fluid heat exchanger 27 is not needed. However, if the temperature of the cooled spiking fluid stored in spiking fluid storage tank 25 is substantially greater than the temperature of the initial LNG in tank 99, then spiking fluid heat exchanger 27 is needed. When spiking fluid heat exchanger 27 is not utilized, spiked LNG is produced by pumping the cooled spiking fluid from spiking fluid storage tank 25 directly to the mixing chamber 43 via conduit 409. In mixing chamber 43, the cooled spiking fluid is mixed with the initial LNG pumped from LNG storage tank 99 via conduit 147 to thereby produce spiked LNG. When spiking fluid heat exchanger 27 is utilized, the cooled spiking fluid exiting spiking fluid storage tank 25 via conduit 409 is further cooled in heat exchange means 29 via indirect heat exchange with LNG in heat exchange means 33,35. The further-cooled spiking fluid is then directed to mixing chamber 43 for combining with initial LNG from initial LNG storage tank 99. Spiked LNG exits mixing chamber 43, and is transported to spiked LNG tank 45 via conduit 149. As mentioned above, the spiked LNG tank 45 can either be a permanent land-based storage tank or a storage tank located on an ocean-going vessel. Most preferably, spiked LNG tank 45 is located on an ocean-going vessel.

In an alternative embodiment similar to the embodiment illustrated in FIG. 3, flash drums 92 and/or 94 can be equipped with one or more additional heat exchange passes that receive the spiking fluid from conduit 409 and return the spiking fluid to conduit 411. In such an embodiment, spiking fluid heat exchanger 27 is eliminated, and cooling of the spiking fluid from spiking fluid storage tank 25 is provided by indirect heat exchange with the flashed fluids (i.e., predominately methane flash vapors and/or LNG) in flash drums 92 and/or 94. When spiking fluid heat exchanger 27 is eliminated, heat exchange means 33,35 and conduits 105,107,111,113,115 are also eliminated.

One key advantage of the LNG facilities illustrated in FIGS. 1-3 are their ability to be readily switched back and forth between a first mode for producing low HHV LNG and a second mode for producing high HHV (spiked) LNG. The LNG facilities of FIGS. 1-3 thus provide an efficient and economical system for supplying LNG which can meet significantly varying product specifications.

In one embodiment of the present invention, the LNG production systems illustrated in FIGS. 1-3 are simulated on a computer using conventional process simulation software. Examples of suitable simulation software include HYSYS™ from Hyprotech, Aspen Plus® from Aspen Technology, Inc., and PRO/II® from Simulation Sciences Inc.

The preferred forms of the invention described above are to be used as illustration only, and should not be used in a limiting sense to interpret the scope of the present invention. Obvious modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A method for liquefying a natural gas stream in an LNG facility, said method comprising:

(a) cooling at least a portion of said natural gas stream in a first closed-loop refrigeration cycle via indirect heat exchange with a first refrigerant to thereby provide a cooled natural gas stream;

(b) introducing at least a portion of an initial LNG produced in said LNG facility into a first LNG tank, wherein said initial LNG comprises at least a portion of said cooled natural gas stream, wherein said initial LNG has a higher heating value (HHV) less than 1,150 BTU/SCF;

(c) removing at least a portion of said initial LNG from said first LNG tank;

(d) cooling a spiking fluid having an HHV greater than 1,500 BTU/SCF in a second refrigeration cycle via indirect heat exchange with a second refrigerant to thereby provide a cooled spiking fluid, wherein said second refrigerant has a different composition than said first refrigerant;

(e) combining at least a portion of said cooled spiking fluid with at least a portion of the removed initial LNG stream to thereby form a spiked LNG stream; and (f) introducing at least a portion of the spiked LNG stream into a second LNG tank.

2. The method according to claim 1, using said LNG facility to generate said spiking fluid.

3. The method according to claim 2, prior to said combining of step (e), storing the spiking fluid in a spiking fluid storage tank.

4. The method according to claim 3, wherein said cooling of step (d) reduces the temperature of said spiking fluid by at least 20° C.

5. The method according to claim 4, said cooling of step (d) being performed prior to said storing of said spiking fluid in the spiking fluid storage tank, said spiking fluid being stored in the spiking fluid storage tank at a temperature of less than about -100° C.

6. The method according to claim 4, said cooling of step (d) being performed after said storing of said spiking fluid in the spiking fluid storage tank.

7. The method according to claim 1, wherein said first and/or said second refrigerants comprise at least 50 mole percent methane, ethane, ethylene, and/or propane.

8. The method according to claim 1, wherein said first refrigerant comprises at least 50 mole percent propane, propylene, ethane, or ethylene, wherein said second refrigerant comprises at least 50 mole percent methane.

9. The method according to claim 1, said second LNG tank being located on an ocean-going vessel.

10. The method according to claim 1, said initial LNG stream having an HHV in the range of from about 925 to about 1,025 BTU/SCF, said spiking fluid having an HHV in the range of from about 2,000 to about 5,000 BTU/SCF, said spiking fluid being comprised of at least about 50 mole percent $C_2$, $C_3$, and/or $C_4$ hydrocarbons.

11. The method according claim 1, said combining of step (e) being carried out in a mixing zone outside of the first and second LNG tanks.

12. The method according to claim 1, vaporizing a least a portion of the spiked LNG.

13. A facility for producing LNG from natural gas, said facility comprising:

a first refrigeration cycle employing a first refrigerant to cool the natural gas via indirect heat exchange;

a first distillation column for receiving at least a portion of the natural gas cooled by the first refrigeration cycle and separating the cooled natural gas into a first relatively more volatile fraction and a first relatively less volatile fraction;

a second refrigeration cycle employing a second refrigerant to further cool at least a portion of said first relatively more volatile fraction to thereby produce initial LNG;

a first tank for receiving and storing at least a portion of the initial LNG;

a second tank for receiving and storing a spiking fluid formed at least partly from said relatively less volatile fraction, a mixing chamber fluidly coupled to and disposed outside of the first and second tanks, said mixing chamber permitting mixing of the fluids from the first and second tanks; and a spiking fluid heat exchanger defining a cooling pass, a first refrigerant pass, and a second refrigerant pass, said cooling pass being fluidly coupled to and located upstream of the second tank, said first refrigerant pass being fluidly coupled to the first refrigeration cycle to thereby permit flow of the first refrigerant therethrough, said second refrigerant pass being configured to permit flow of a portion of the initial LNG therethrough.

14. The facility according to claim 13; and a first pump for transporting at least a portion of the initial LNG from the first tank to the mixing chamber, a second pump for transporting at least a portion of the spiking fluid from the second tank to the mixing chamber.

15. The facility according to claim 13; and a third tank fluidly coupled to the mixing chamber, said third tank being configured to receive fluids mixed in the mixing chamber.

16. The facility according to claim 15; and a conduit fluidly coupled to and extending between the first and third tanks, said mixing chamber being defined by the conduit.

17. The facility according to claim 13, said third tank being located on an ocean-going vessel.

18. A facility for producing LNG from natural gas, said facility comprising:

a first refrigeration cycle employing a first refrigerant to cool the natural gas via indirect heat exchange;

a first distillation column for receiving at least a portion of the natural gas cooled by the first refrigeration cycle and separating the cooled natural gas into a first relatively more volatile fraction and a first relatively less volatile fraction;

a second refrigeration cycle employing a second refrigerant to further cool at least a portion of said first relatively more volatile fraction to thereby produce initial LNG;

a first tank for receiving and storing at least a portion of the initial LNG;

a second tank for receiving and storing a spiking fluid formed at least partly from said relatively less volatile fraction, a mixing chamber fluidly coupled to and disposed outside of the first and second tanks, said mixing chamber permitting mixing of the fluids from the first and second tanks; and a spiking fluid heat exchanger defining a cooling pass and a first refrigerant pass, said cooling pass being fluidly coupled to and disposed between the second tank and the mixing chamber, said first refrigerant pass being fluidly coupled to the first refrigeration cycle to thereby permit flow of the first refrigerant therethrough, said spiking fluid heat exchanger defining a second refrigerant pass, said second refrigerant pass being configured to permit flow of a portion of the initial LNG therethrough.

19. A method for producing LNG of varying high heating value (HHV) in a single LNG facility, said method comprising:

(a) operating said LNG facility in a first mode of operation to thereby produce low HHV LNG;

(b) transporting at least a portion of said low HHV LNG to a first LNG market;

(c) operating said LNG facility in a second mode of operation to thereby produce high HHV LNG; and (d) transporting at least a portion of said high HHV LNG to a second LNG market, wherein each of said first and said second modes of operation comprise producing an initial LNG having a HHV less than about 1,150 BTU/SCF and a spiking fluid having a HHV greater than about 1,500 BTU/SCF, wherein said spiking fluid is not combined with said initial LNG in said first mode of operation, wherein said low HHV LNG product comprises at least a portion of said initial LNG, wherein at least a portion of said spiking fluid is combined with said initial LNG in said second mode of operation to thereby provide a spiked LNG, wherein said high HHV LNG comprises at least a portion of said spiked LNG.

20. The method according to claim 19, wherein said first and said second LNG markets are physically located in different geographic regions of the world.

21. The method according to claim 19, wherein each of said first and said second modes of operation comprise storing at least a portion of said initial LNG in a first LNG tank and storing at least a portion of said spiking fluid in a spiking fluid tank.

22. The method according to claim 21, wherein said second mode of operation comprises combining said spiking fluid and said initial LNG in a mixing zone to thereby provide said spiked LNG, wherein said mixing zone is located outside of said first LNG tank and said spiking fluid tank.

23. The method according to claim 21, wherein said initial LNG and said spiking fluid are respectively stored in said first LNG lank and said spiking fluid tank at a pressure in the range of from about 0.9 to about 1.5 bar.

24. The method according to claim 21, wherein said at least a portion of said spiking fluid combined with said initial LNG during said second mode of operation is withdrawn from said spiking fluid tank.

25. The method according to claim 24, wherein said second mode of operation further comprises cooling said spiking fluid before or after said storing of said spiking fluid in said spiking fluid tank.

26. The method according to claim 25, wherein at least a portion of said cooling of said spiking fluid is accomplished with at least a portion of said initial LNG.

27. The method according to claim 19, wherein the HHV of said high HHV LNG is at least about 8 percent different than the HHV of said low HHV LNG.

28. The method according to claim 19, further comprising, prior to said transporting of step (d), introducing at least a portion of said high HHV LNG into a spiked LNG tank, wherein said spiked LNG tank is located on an ocean-going vessel.

29. The method according to claim 19, wherein said initial LNG has an HHV in the range of from about 850 to about 1,100 BTU/SCF, wherein said spiking fluid has an HHV in the range of from about 1,750 to about 8,000 BTU/SCF, wherein said spiked LNG has an HHV in the range of from about 20 to about 400 BTU/SCE greater than the HHV of the initial LNG.

* * * * *